US007698751B2

(12) United States Patent
Chiang

(10) Patent No.: US 7,698,751 B2
(45) **Date of Patent: *Apr. 20, 2010**

(54) SWIMMING GOGGLES

(76) Inventor: Herman Chiang, 11F-2, No. 634-9, Ching-Ping RD., Chung-Ho City, Taipei Hsien (TW)

( * ) Notice: Subject to any disclaimer, the term of this patent is extended or adjusted under 35 U.S.C. 154(b) by 404 days.

This patent is subject to a terminal disclaimer.

(21) Appl. No.: 11/595,904

(22) Filed: Nov. 13, 2006

(65) Prior Publication Data

US 2008/0111966 A1 May 15, 2008

(51) Int. Cl.
*A61F 9/02* (2006.01)

(52) U.S. Cl. ..... 2/450; 2/448; 2/452; 2/426

(58) Field of Classification Search ..... 2/410, 2/425, 426, 431, 432, 434, 435, 436, 438, 2/440, 441, 442, 443, 445, 446, 447, 448, 2/452

See application file for complete search history.

(56) References Cited

U.S. PATENT DOCUMENTS 6,349,420 B1 * 2/2002 Chiang ..... 2/428
7,020,904 B2 * 4/2006 Chiang ..... 2/442
7,146,653 B2 * 12/2006 Chou ..... 2/426
7,146,654 B2 * 12/2006 Chiang ..... 2/428
2004/0210991 A1 * 10/2004 Chiang ..... 2/445
2005/0273914 A1 * 12/2005 Chiang ..... 2/428
2006/0010585 A1 * 1/2006 Chiang ..... 2/426
2007/0028371 A1 * 2/2007 Chiang ..... 2/426
2007/0118978 A1 * 5/2007 Chiang ..... 2/426

* cited by examiner

*Primary Examiner*—Gary L Welch
*Assistant Examiner*—Sally C Cline
(74) *Attorney, Agent, or Firm*—Rosenberg, Klein & Lee

(57) ABSTRACT

Swimming goggles include a left frame, a right frame, hard holding frames and strap elements. A connecting portion connects the left frame and the right frame. The left frame and right frame are both formed of soft material. Each of the left frame and the right frame includes an inner surface, and an outer surface, and an intermediate surface between the inner surface and the outer surface. Lenses are received between the inner surfaces and the outer surfaces of the left frame and right frame. Hard holding frames respectively clamp the left frame and right frame. Strap elements are formed on outward lateral sides of the hard holding frames for receiving a head strap. Pads are provided on the left frame and the right frame for comfortably contacting users. The connecting portion is flexible so that fitting to various users with different face profiles without hazard of water leakage.

12 Claims, 5 Drawing Sheets

SWIMMING GOGGLES

BACKGROUND OF THE INVENTION

1. Field of the Invention

The present invention relates to swimming goggles, and particularly to swimming goggles which have hard frames pressing lenses of a soft lens frames and which provide comfortable fitting and are adjusted conveniently in use.

2. Related Art

In general, swimming goggles are divided into two types. The first type includes a left frame and a right frame, which are separate from each other and are connected by a connecting member. The second type comprises a left frame and a right frame, which are integrated with a connecting member together. Nevertheless, as of the second type, material of the left frame and the right frame needs to be hard enough for reliably fixing lenses on the left frame and the right frame. Accordingly, pads on the left frame and the right frame are relatively rigid, making users feel uncomfortable.

Furthermore, width of users' faces may be different from person to person. The left frame and the right frame may be too rigid to fit close to users' faces, therefore taking risk of water seepage.

SUMMARY OF THE INVENTION

Accordingly, an object of the present invention is to provide swimming goggles which provide comfortable feeling for users and prevent from water leakage effectively.

The swimming goggles includes a left frame and a right frame both formed of soft material. Each of the left frame and the right frame includes an inner surface, and an outer surface, and an intermediate surface connecting the inner surface and the outer surface. Lenses are received between the inner surfaces and the outer surfaces of the left frame and right frame. A connecting portion is formed between the left frame and the right frame. Hard holding frames respectively clamp the left frame and right frame. Strap elements are formed on outward sides of the hard holding frames. Ledges project from outward sides of the outer surfaces of the left frame and the right frame for assembling the hard holding frames thereon.

Link portions are respectively provided on the hard holding frames and appropriately project towards the left and right frames. The link portions are respectively adjacent to the joint of the left frame with the connecting portion and the joint of the right frame with the connecting portion for engaging with the inner surfaces and the intermediate surfaces when assembled, whereby the link portions and the hard holding frames hold the left frame and the right frame consecutively and retentively.

Embedding grooves are defined respectively in a joint of the left frame with the connecting portion and a joint of the right frame with the connecting portion, and extend from the inner surfaces to the intermediate surfaces for receiving the link portions.

Assembling slots are respectively defined in outward lateral sides of the outer surfaces of the left frame and the right frame. Biasing arms are respectively located at outward lateral sides of the hard holding frame for extending through the assembling slots to press against the inner surfaces of the left frame and the right frame.

Each strap element comprises a base, a rolling shaft, a buckle, and a head strap with stopping grooves. The base is integrally formed with the hard holding frame, and includes a body and a pair of bars extending from the body with appropriate distance apart from the body. First assembling holes are respectively defined in the bars and corresponding to each other for assembling the rolling shaft thereon. The buckle forms a post thereon, and second assembling holes are respectively defined in the bars for assembling the post thereon. A latch is formed on the buckle for biasing against the stopping grooves of the head strap. In this way, length of the head strap is permitted to be adjusted.

DESCRIPTION OF THE PREFERRED EMBODIMENTS

Figure 1:
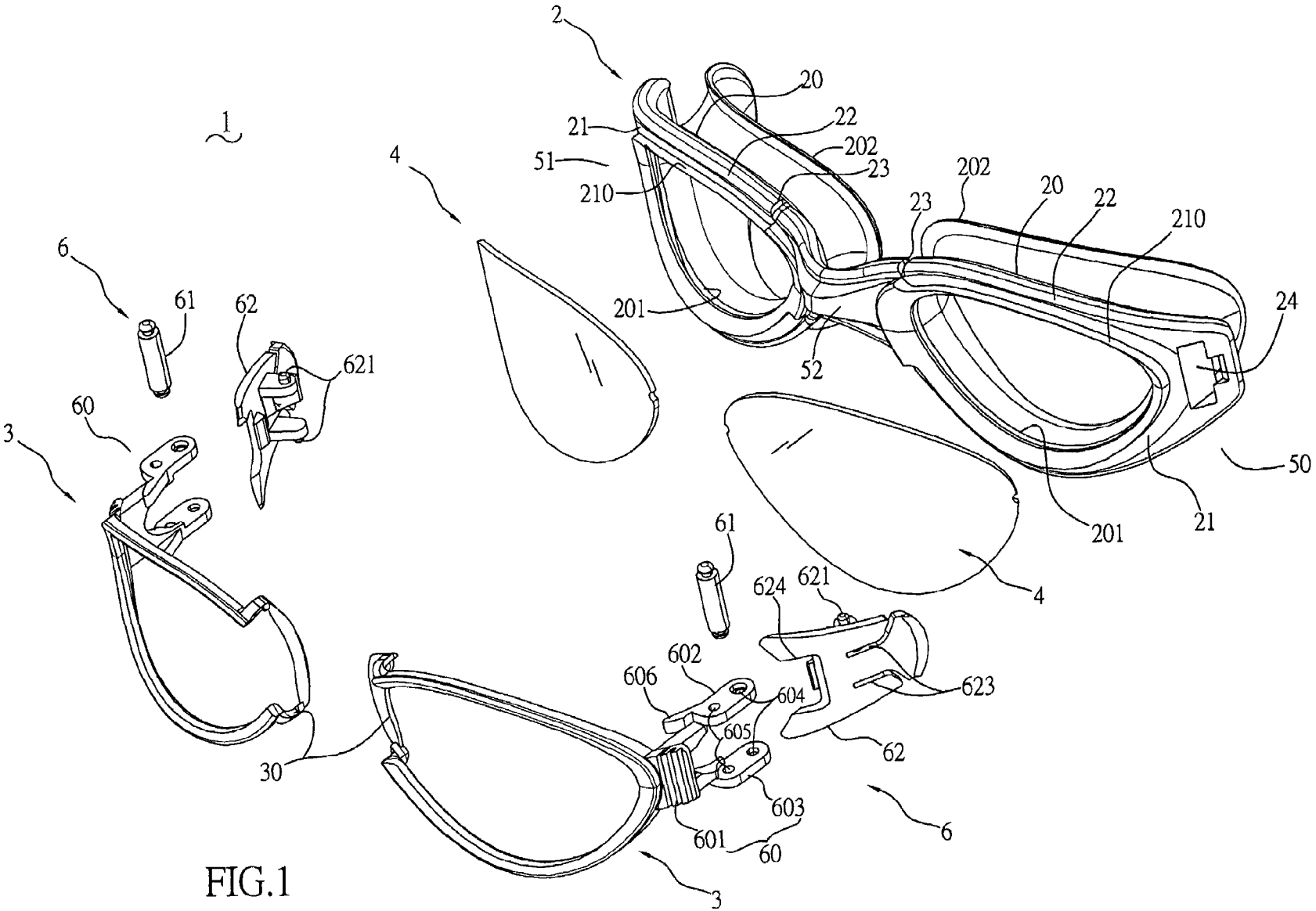
FIG. 1 is an exploded view of swimming goggles of the present invention.

With reference to FIG. 1, swimming goggles 1 in accordance with the present invention includes a soft lens frame 2, a hard holding frames 3, lenses 4 and strap elements 6. The soft lens frame 2 is unitarily formed of soft material, for example silica gel, and has a left frame 50, a right frame 51 and a connecting portion 52 connecting the left frame 50 and the right frame 51. Each of the left frame 50 and the right frame 51 includes an inner surface 20, an outer surface 21, and an intermediate surface 22 connecting the inner surface 20 and the outer surface 21. The inner surfaces 20 define lens grooves 201 for receiving the lenses 4 therein. Pads 202 are integrally formed on inward sides of the inner surfaces 20 for touching to a user's face comfortably. Ledge 210 respectively projects from each of the outer surface 21 of the left frame and the right frame for assembling the hard holding frames 3 thereon. Embedding grooves 23 are defined respectively in a joint of the left frame 50 with the connecting portion 52 and a joint of the right frame 51 with the connecting portion 52, and extend from the inner surfaces 20 to the intermediate surfaces 22. Assembling slots 24 are respectively defined in outward lateral sides of the outer surfaces 21 for assembling the strap elements 6.

The hard holding frames 3 are made of Polypropylene (PP), and are separated from each other for individually corresponding to the left frame 50 and the right frame 51. The hard holding frames 3 clamp the ledges 210 when assembled. Link portions 30 are respectively provided on the hard holding frames 3 and appropriately project towards the left and right frames 50, 51. When assembled, the link portions 30 are respectively adjacent to the joint of the left frame 50 with the connecting portion 52 and the joint of the right frame 51 with the connecting portion 52. In assembly, the link portions 30 engage with the inner surfaces 20 and the intermediate surfaces 22. Thus, the link portions 30 and the hard holding frames 3 hold the left frame 50 and the right frame 51 consecutively and retentively.

The strap elements 6 are provided on outward lateral sides of the hard holding frames 3. Each strap element 6 includes a base 60, a rolling shaft 61, a buckle 62, and a head strap 63 (shown in FIG. 8) with stopping grooves (not labeled). The base 60 is integrally formed with the hard holding frame, and includes a body 601, and a pair of bars 602, 603 extending from the body 601 and with appropriate distance apart from the body 601. First assembling holes 604 are respectively defined in the bars 602, 603 and correspond to each other, and second assembling holes 605 are respectively defined in the bars 602, 603 and correspond to each other. Biasing arms 606 are respectively formed on the bars 602, 603 and at outward lateral sides of the hard holding frame 3, and are inclined inwardly for extending through the assembling slots 24 to press against the inner surfaces 20 of the left frame 50 and the right frame 51. The assembling slots 24 respectively have a size corresponding to the bars 602, 603 such that the biasing arms 606 are allowed to extend through the assembling slots 24 to press against the inner surfaces 20 of the left frame 50 and the right frame 51. The rolling shaft 61 is assembled on the first assembling holes 604 for supporting the head strap 63. The buckle 63 forms a post 621 for being mounted on the second assembling holes 605. A latch 622 is formed on the buckle 62 for biasing against the stopping grooves 631 of the head strap 63. In this way, length of the head strap 63 is permitted to be adjusted. A couple of slits 623 are defined in the buckle 62 and respectively at both sides of the latch 622 for providing flexibility. A U-shaped portion 624 is formed on the buckle 62 for pressing the outer surface 21 of the left frame 50 the right frame 51. A recess (not labeled) of the U-shaped portion 624 corresponds to the base 60 when assembled.

Figure 2:
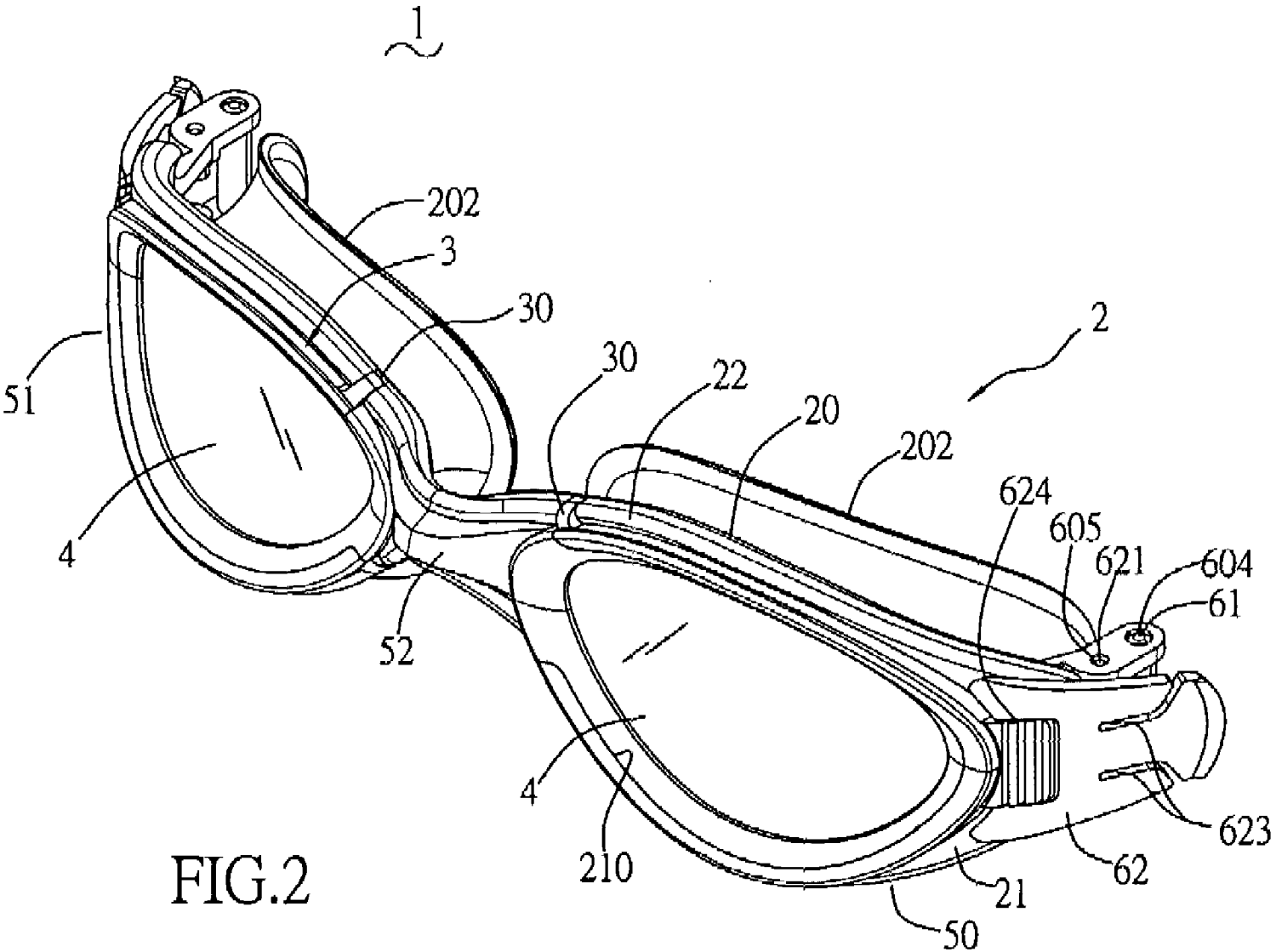
FIG. 2 is an assembled view of the swimming goggles of FIG. 1.
Figure 4:
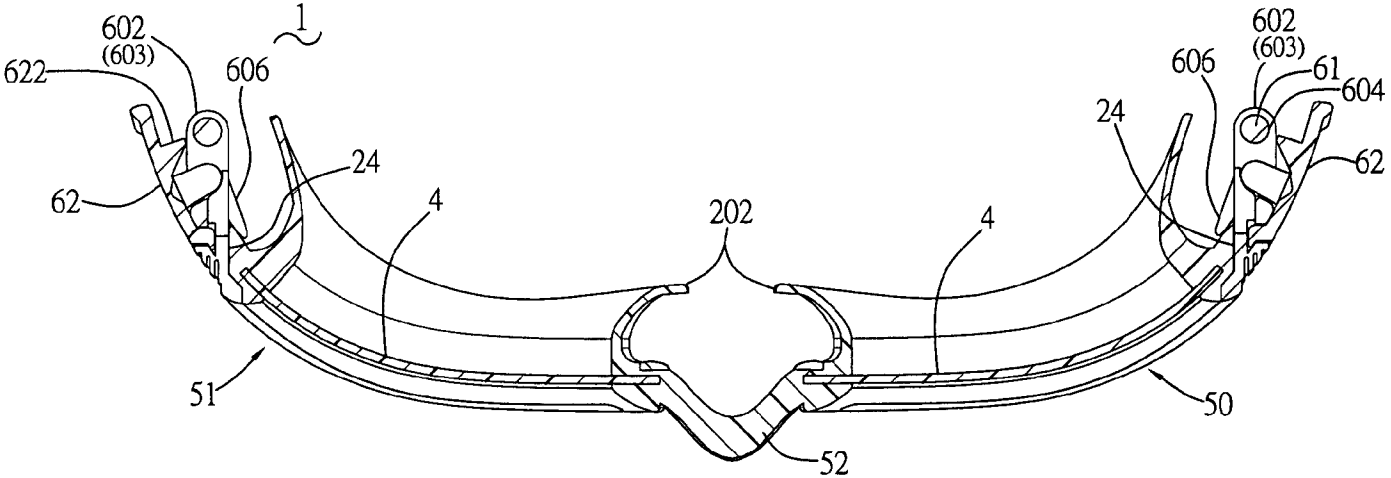
FIGS. 4, 5, 6, 7 are respectively cross-sectional views taken along the line 4-4, the line 5-5, the line 6-6 and the line 7-7 in FIG. 3.
Figure 3:
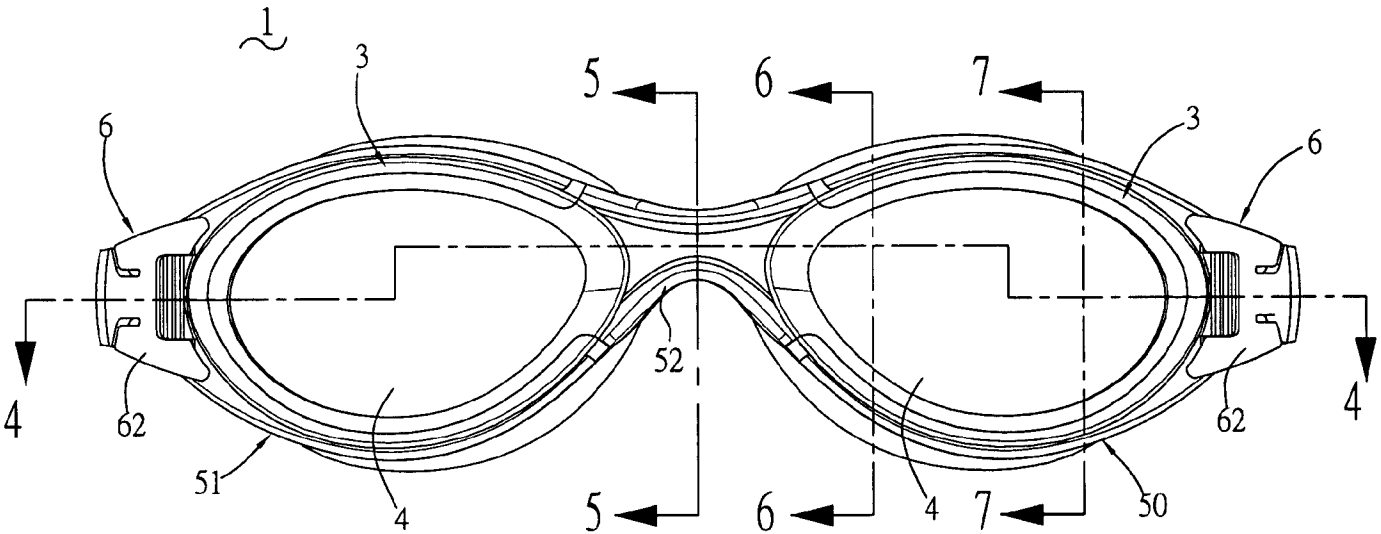
FIG. 3 is a front view of the swimming goggles of FIG. 2.
Figure 7:
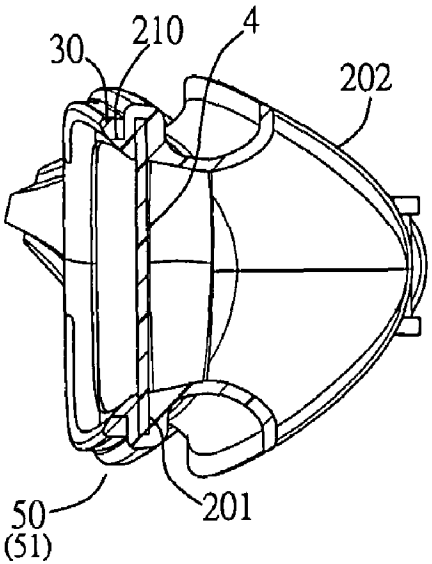
Figure 6:
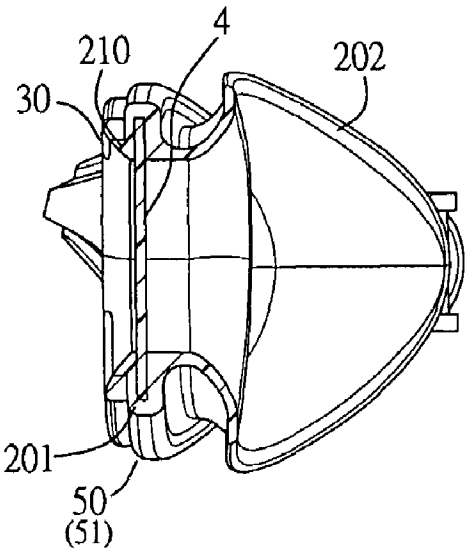
Figure 5:
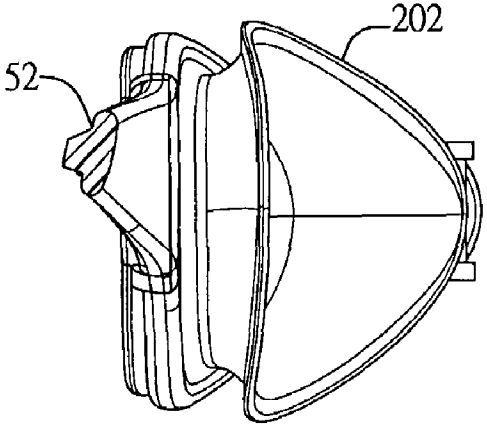

Further referring to FIGS. 2 to 4, in assembly, the lenses 4 are respectively received between the inner surfaces 20 and the outer surfaces 21 of the left frame 50 and the right frame 51, and are fixed in the lens grooves 201. The link portions 30 of the hard holding frames 3 are respectively assembled on the embedded grooves 23 of the left frame 50 and the right frame 51. The link portions 30 are retained to the inner surfaces 20 and the intermediate surfaces 22. The hard holding frames 3 are retained to the ledges 210. Thus, the link portions 30 and the hard holding frames 3 hold the left frame 50 and the right frame 51 consecutively with retention. The bars 602, 603 respectively extend through the assembling slots 24 and press against the lenses 4, as shown in FIG. 2. Notably, as shown in FIG. 4, the biasing arms 606 of the bars 602, 603 bias against the inner surfaces 20 of the left frame 50 and right frame 51. The rolling shafts 61 are assembled on the first assembling holes 604 for supporting the head straps 63 (shown in FIG. 8). Finally, the posts 621 of the buckles 62 are assembled on the second assembling holes 605. Referring to FIGS. 6 and 7, the hard holding frames 3 clamp the ledges 210, whereby the lenses 4 are fixedly sandwiched in the lens grooves 201 of the left frame 50 and right frame 51. Further referring to FIG. 5, the connecting portion 52 possesses maximum flexibility, thereby closely fitting to various users with different face profiles and eliminating hazard of water leakage.

Figure 8:
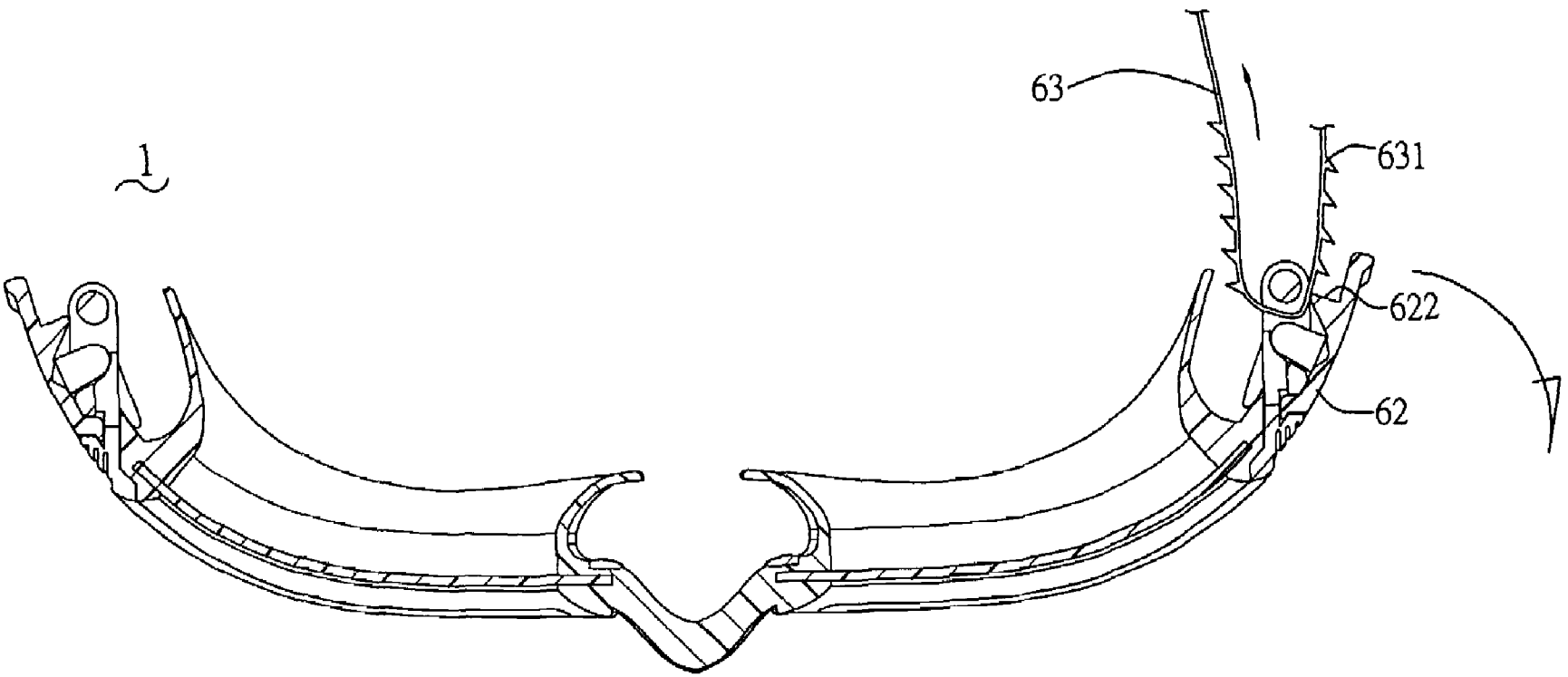
FIG. 8 schematically shows a head strap of the swimming goggles being adjusted toward loosening.

Referring to FIG. 8, the buckle 62 are pulled outwardly (as the arrow shown in FIG. 8), and the latch 622 disengages from the stopping grooves 631. The head strap 63 is permitted to be adjusted toward loosening. When the buckle 62 is released, the latch 622 abuts against the stopping grooves 631, and the head strap 63 is only allowed to be adjusted toward tightening. Therefore the head strap 63 is adjusted conveniently.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. Swimming goggles comprising:

a left frame and a right frame both formed of soft material, the left frame and the right frame respectively including inner surfaces, outer surfaces, and intermediate surfaces connecting the inner surfaces and the outer surfaces, lenses being received between the inner surfaces and the outer surfaces of the left frame and right frame;

a connecting portion between the left frame and the right frame;

a pair of hard holding frames, each hard holding frame respectively clamping the left frame and right frame;

strap elements provided on outwardsides of the hard holding frames; and a pair of link portions, each link portion respectively provided on the hard holding frames and project towards the left and right frames; the link portions being respectively adjacent to a joint formed between the left frame and the connecting portion, and a joint formed between the right frame and the connecting portion for engaging with the inner surfaces and the intermediate surfaces;

wherein embedding grooves are defined respectively in the joint formed between the left frame and the connecting portion, and the joint formed between the right frame and the connecting portion, each embedding grooves extend from the inner surface to the intermediate surface for receiving a respective link portion.

2. The swimming goggles as claimed in claim 1, wherein a ledge respectively projects from each of the outer surfaces of the left frame and the right frame for assembling the hard holding frames thereon.

3. The swimming goggles as claimed in claim 2, wherein the connecting portion is made of the same material as the left frame and the right frame, and is unitarily formed with the left frame and the right frame.

4. The swimming goggles as claimed in claim 3, wherein the left frame is unitarily formed with the right frame, and wherein pads are provided on the left frame and the right frame.

5. The swimming goggles as claimed in claim 1, wherein the hard holding frames are separated from each other for individually corresponding to the left frame and the right frame.

6. The swimming goggles as claimed in claim 1, wherein assembling slots are respectively defined in outward lateral sides of the outer surfaces of the left frame and the right frame, and wherein biasing arms are respectively located at outward lateral sides of the hard holding frame for extending through the assembling slots to press against the inner surfaces of the left frame and the right frame.

7. The swimming goggles as claimed in claim 6, wherein each strap element comprises a base, a rolling shaft, and a head strap with stopping grooves, the base being integrally formed with the hard holding frames, and including a body and a pair of bars extending from the body, first assembling holes being respectively defined in the bars and corresponding to each other, the rolling shaft being assembled on the first assembling holes.

8. The swimming goggles as claimed in claim 7, wherein each strap element further comprises a buckle with a post thereon, second assembling holes being respectively defined in the bars and corresponding to each other for assembling the post thereon, a latch being formed on the buckle for biasing against the stopping grooves of the head strap.

9. The swimming goggles as claimed in claim 8, wherein a couple of slits are defined in the buckle and respectively at both sides of the latch for providing flexibility, and wherein a U-shaped portion is formed on the buckle for pressing the outer surfaces of the left frame/the right frame, a recess of the U-shaped portion corresponding to the base.

10. The swimming goggles as claimed in claim 9, wherein the biasing arms are integrally formed with bars and are inclined inwardly.

11. The swimming goggles as claimed in claim 10, wherein the assembling slots respectively have a size corresponding to the bars such that the biasing arms are allowed to extend through the assembling slots to press against the inner surfaces of the left frame and the right frame.

12. The swimming goggles as claimed in claim 1, wherein the left frame is unitarily formed with the right frame, and wherein pads are provided on the left frame and the right frame.

* * * * *